United States Patent [19]

Gamow et al.

[11] Patent Number: 4,974,829

[45] Date of Patent: Dec. 4, 1990

[54] HYPERBARIC CHAMBER

[75] Inventors: Rustem I. Gamow, Boulder; Geoffrey A. Geer, Durango, both of Colo.

[73] Assignee: Portable Hyperbarics, Inc., Ilion, N.Y.

[21] Appl. No.: 10,046

[22] Filed: Feb. 2, 1987

Related U.S. Application Data

[63] Continuation-in-part of Ser. No. 743,011, Jun. 10, 1985, abandoned.

[51] Int. Cl.[5] ..... A62B 11/00

[52] U.S. Cl. ..... 272/3; 52/2 D; 52/2 N; 128/202.12; 128/205.26

[58] Field of Search ..... 272/1 B, 1 E, 1 R, 2, 272/3, 4, 5; 73/4 R, 4 D; 441/87; 220/3; 48/174, 178; 52/2 D, 2 N, 144, 26; 405/192–194; 128/202.12, 205.26

[56] References Cited

U.S. PATENT DOCUMENTS

| | | | |
|---|---|---|---|
| 1,294,188 | 2/1919 | Stelzner . | |
| 2,401,230 | 5/1946 | Colley . | |
| 2,723,840 | 1/1956 | De Sanctis . | |
| 2,731,055 | 1/1956 | Smith | 52/2 N |
| 3,299,429 | 1/1966 | Conrad | 52/144 X |
| 3,387,412 | 6/1968 | Kwake | 52/2 D |
| 3,602,221 | 8/1971 | Bleicken . | |
| 3,729,002 | 4/1973 | Miller . | |
| 3,801,043 | 2/1974 | Jones, III | 272/3 |
| 4,103,369 | 8/1978 | Riordan | 52/2 D X |
| 4,106,504 | 8/1978 | York . | |
| 4,186,735 | 2/1980 | Henneman . | |
| 4,196,656 | 4/1980 | Wallace et al. | 405/192 X |
| 4,294,242 | 10/1981 | Cowans . | |
| 4,407,723 | 10/1983 | MacGregor . | |
| 4,423,723 | 1/1984 | Winkler et al. . | |
| 4,440,162 | 4/1984 | Sewell . | |
| 4,509,513 | 4/1985 | Lasley | 128/202.12 |
| 4,567,696 | 2/1986 | Malet | 52/2 D |
| 4,627,431 | 12/1986 | Werjefelt . | |

FOREIGN PATENT DOCUMENTS

| | | | |
|---|---|---|---|
| 970939 | 3/1953 | Fed. Rep. of Germany . | |
| 3004156 | 8/1981 | Fed. Rep. of Germany | 128/202.12 |
| 854923 | 1/1940 | France . | |
| 889007 | 12/1981 | U.S.S.R. | 128/205.26 |

*Primary Examiner*—Jr. Chilcot

*Attorney, Agent, or Firm*—Greenlee and Associates

[57] ABSTRACT

A portable hyperbaric chamber that allows a person to perform endurance exercise at barometric pressures of from 0 to 10 lbs/square inch greater than ambient. The chamber is portable, semi-spherical and inexpensively constructed of an essentially air-impermeable, flexible material. The chamber is used for endurance conditioning, to improve the athletic performance of people who live at altitudes above sea level.

6 Claims, 4 Drawing Sheets

HYPERBARIC CHAMBER

This application is a continuation-in-part of U.S. application Ser. No. 743,011, filed June 10, 1985, abandoned.

INTRODUCTION AND BACKGROUND

As man roams the globe, from climbing high mountains to exploring ocean depths, increasing instances occur of detrimental effects of acute or chronic exposure to altitude or to reduced ambient pressure. A variety of acute, subacute and chronic conditions related to brief or prolonged exposure to altitude (or to decompression, in the case of divers and others working at elevated pressure) are nevertheless alleviated by treatment in a hyperbaric atmosphere. (The term "hyperbaric" is used herein to mean a pressure greater than ambient, over and above the range of pressure variation encountered in the course of normal fluctuations in atmospheric pressure caused by changes in the weather.)

It is well known that humans ascending to altitude may experience a variety of symptoms collectively known as "mountain sickness". The symptoms of mountain sickness are especially prevalent with people coming from sea level to ski at ski resorts 2000 meters and higher above sea level. In general, these symptoms are not severe and after a few days of nausea and headache the symptoms go away. Nevertheless, some individuals are dreadfully sick even at these low altitudes, and it would be beneficial to get them to a higher barometric pressure as soon as possible.

On the other hand, severe mountain sickness which includes the following diseases: acute mountain sickness, high altitude pulmonary edema, Monge's disease and Brisket disease, are of major concern for mountaineers. The problems for mountaineers are of course very much greater than for the recreational skiier. First, the altitudes may be very much greater, approaching 10,000 meters, and the physical condition of the climbers themselves is greatly weakened not only from the altitude but from the long term exposure to extreme elements. All life supporting systems must be carried by foot and be contained in backpacks. To date, if a climber becomes severely ill because of the altitude the only treatment is to get him or her to as low an elevation as possible as soon as possible. This is often not done because weather and terrain conditions may trap the climbers for days, if not weeks.

A second problem that mountaineers experience at altitude is the inability to maintain a regular sleep cycle. This problem is more severe for some climbers than others, but it is a problem for every high altitude climber.

In addition to detrimental effects which may be hazardous to health, changes in altitude are known to affect athletic performance. It is well known that persons who normally live at or near sea level experience such symptoms as shortness of breath and dizziness when they travel to high altitudes. The symptoms usually wear off in one to two weeks. Such experiences have been explained as being the result of reduced ambient oxygen tension in high altitude air (See Abstracts, International Symposium on the Effects of Altitude on Physical Performance, March 3-6, 1966, Albuquerque, New Mexico). Initial acclimatization has been shown to be accompanied by an increase in circulating red blood cells presumably put into circulation to enhance the blood's oxygen-carrying capacity (Ibid.). Full acclimatization is achieved after 2-3 months, and is accompanied by an increased hematocrit.

It has been recommended (Castro, R., "Altitude Offers Big Training Advantage", *Boulder Daily Camera, Sept.* 14, 1978) that athletes engaged in sports such as running, cycling and the like, where a high level of cardiovascular output is required, should train at altitudes. It is generally accepted by athletes that altitude training is beneficial (see Williams, K., "Boulder is Training Haven for Runners", *Boulder Daily Camera, April* 22, 1985). The recommendation is based on the rationale that the normal acclimatization to altitude will generally improve cardiovascular efficiency, and hence athletic performance.

Practical application of the foregoing rationale has not been demonstratably successful. Many athletes trained at altitude prior to competing in the 1968 Olympics, held in Mexico City (7500 feet). Even with this altitude training, no new records in track endurance events were set that year (Daniels, J. & Oldrige, N., "The effects of altitude exposure to altitude and sea level on world class middle distance runners" in *Medicine and Science in Sports*, Vol. 2, No. 3, pp. 107-112, 1970). Recently evidence has been reported that casts doubt on the notion that athletes who have lived and trained at altitude would have an advantage in terms of performing endurance events at altitude or near sea level (Grover, R.F. et al. (1976) Circulation Res. 38,391:3). Grover has shown that the total volume of blood declines by as much as 25 percent as the body responds to high altitude. This decrease in blood volume causes an increase in blood viscosity that in turn causes the heart to decrease the amount of blood pumped. Since endurance athletic performance is thought to be dependent on the amount of oxygen in the blood, a decrease in blood volume might result in a decrease in athletic performance. This decrease in plasma volume results in the well-known phenomenon of measuring an increase in red blood cell concentration (hematocrit) as a result of acclimatization to altitude. Doctors who work in the field of sport medicine have long known that athletes have a condition known as sports anemia (Pate, R.R. (1983), "Sports Anemia: A Review of the Current Research Literature" in *The Physician and Sports Medicine*, Vol. 2, No. 2). They appear to have fewer red blood cells, but in reality they have an increase in plasma volume. One interpretation is that this increase in plasma volume allows the heart to perform to its maximum ability, thereby increasing athletic performance.

The present invention provides a unique device, a portable hyperbaric chamber, adapted in various ways to provide a temporary environment of elevated pressure. The device is described with respect to specific adaptations thereof, in order to demonstrate certain new uses, not heretofore available. In one embodiment, the device serves as an exercise environment, permitting an improved endurance training regimen. In another embodiment, the device is adapted for the emergency treatment of "mountain sickness" or acute pulmonary edema. The disclosed uses are novel, no previous device being available to perform the functions of the device of the present invention.

While not based upon any specific theory or hypothesis, the present invention provides in one embodiment a novel and unobvious method of endurance conditioning and apparatus for carrying out such a method, which is consistent with the foregoing observations. This embodiment of the invention is based on the premise that, contrary to the widely held view that endurance training at altitude is beneficial to athletic performance, the opposite is in fact the case: athletic performance in endurance-type events is improved at all altitudes by undertaking the training exercises at an atmospheric pressure equal to, or even greater than, the normal pressure at sea level. The benefit of training at such pressures is obtainable by persons living at altitude, provided the training exercises themselves are carried out at sea level or greater than sea level pressures. The invention includes the design and construction of a hyperbaric chamber that would allow an athlete living at altitude to train at or below sea level, either in his or her own home or in an athletic club.

Another embodiment of the invention described herein provides a unique solution to the alleviation of mountain sickness, pulmonary edema and sleep cycle disruption due to altitude by providing a portable hyperbaric chamber which can be folded or collapsed and carried in a backpack, to be deployed as needed to simulate a lower altitude for a climber suffering mountain sickness without moving the climber to a lower altitude.

Hyperbaric chambers of the prior art have been heavy, rigid structures, permanently installed. Any structure of rectilinear design must be constructed of extremely strong and heavy materials, even to maintain 10 pounds per square inch pressure greater than ambient. Structures with such design are permanently installed. Cylindrical chambers large enough to admit a human being and allow movement within the chamber have been disclosed (see, e.g., Wallace et al., U.S. Pat. No. 4,196,656), but such structures are not truly portable, which term is used herein to mean capable of being dismantled, packaged and carried by an individual person. Air-supported structures, tennis domes, radomes and the like, are distinguished from the devices of the present invention by the fact that only a minuscule increment of pressure is needed to maintain such structures in an inflated condition. For example, a pressure differential of only 70 mm water pressure is all that is required to maintain the rigidity of a radar dome of 15 meter diameter in winds up to 240 mph. In units of psi, 70 mm of water is approximately 0.1 lb/sq. inch, an amount within the range of normal atmospheric fluctuations due to weather conditions and not hyperbaric as herein defined. Examples of air-supported, but non-hyperbaric structures are shown by Dent, R. N., *Principles of Pneumatic Architecture* (1972), John Wiley, & Sons, Inc., New York; by Riordan, U.S. Pat. No. 4,103,369; and by Jones III, U.S. Pat. No. 3,801,093.

SUMMARY OF THE INVENTION

The device of the present invention is designed to provide a portable, compact hyperbaric enclosure for temporary use by a human being or other terrestrial mammal for a beneficial health-related effect. Embodiments of the device are adapted to achieve specific beneficial effects, including, as exemplified herein, relief from altitude sickness, pulmonary edema, rapid decompression, and improved endurance conditioning for athletes training at altitude. The shapes and sizes of such embodiments vary according to their specific use. For example, an embodiment designed to provide a hyperbaric environment for a climber suffering from altitude sickness need not be much larger than a sleeping bag, while a device for exercise training must be large enough to permit a range of movements or to contain a desired exercise device such as an exercise bicycle, rowing machine or the like. All embodiments nevertheless present common features of construction such as spherical or near-spherical sides along a least one axis of symmetry, construction of flexible, non-breathable material, means for achieving and maintaining air (or other gas mixture) pressure inside the chamber adjustable from 0–10 lbs per square inch greater than ambient, and means for ingress and egress which can be closed to prevent air loss. Alternative devices have means for achieving and maintaining air or other gas mixture pressure inside the chamber from 0.2 psi to 10 psi greater than ambient and in preferred embodiments the pressure is achieved and maintained in the range from 0.2 psi to 4 psi above ambient.

The embodiment used for exercise training is referred to herein as the exercisor. One embodiment of the exercisor is an eight foot in diameter spherical chamber, made of a non-breathable fabric that can be inflated to hyperbaric pressure using air pumping means such as a portable air compressor. The air can be continuously circulated in the sphere by simultaneously controlling the internal pressure by means of an inlet valve and an exhaust valve. Within the exercisor there can be any desired stationary exercising units such as a bike or a treadmill. The entire sphere can be designed to be portable, aesthetically pleasing and to include windows to avoid any closed-in feeling. Optionally, instruments could be added to the exercisor such as a barometer, and devices to measure heart rate, breathing rate or body temperature.

The exercisor is then used for endurance conditioning by carrying out the exercise routines which comprise the athlete's training regimen within the exercisor, at sea level barometric pressure or greater. Maximum benefit will be obtained by exercising daily within the exercisor for a period sufficient to elicit maximum cardio-pulmonary performance. By using the exercisor in this manner, the athlete achieves the equivalent benefit of training at sea level, even though the majority of his or her waking hours is lived at a higher elevation. Even better performance can be achieved by carrying out the exercise program at a barometric pressure greater than sea level.

We disclose herein a portable hyperbaric chamber designed for athletes who live at altitude but would like to be able to perform endurance training at sea level atmospheric pressure, or below sea level. The hyperbaric exercisor is advantageous for several uses:

1. For athletes who live at altitude but wish to train at sea level in order to enhance their athletic performance.

2. For future experimentation using either animals or human subjects to determine whether training at below sea level atmospheric pressure would further enhance athletic performance above that achieved at sea level.

An embodiment used for alleviating mountain sickness and pulmonary edema will be referred to herein as a hyperbaric mountain bubble.

A hyperbaric mountain bubble is constructed of a flexible, non-breathable fabric capable of retaining air at a pressure of from about 0.2 psi to about 10 psi gage, large enough to enclose a human being. The bubble has means for ingress and egress which may be closed to provide an essentially air-tight seal. Means for inflating the bubble and achieving an elevated pressure of from about 0.2 psi to about 10 psi gage and valve means for controlling air pressure are provided. Optionally, means for scavenging excess moisture and carbon dioxide from the interior may be provided, although such devices need not be integral to the bubble.

The bubble is constructed in a spherical, semi-spherical or "sausage" shape (cylindrical with hemispherical ends). The bubble may be fully self-supporting or it may have flexible wands or other means for extending the structure to an ambient pressure inflated condition before being pressurized.

The bubble can be used for any condition of mountain sickness, sleep cycle disruption or pulmonary edema, where a decreased altitude (or increased ambient air pressure) is desired. Each pound per square inch of pressure above ambient corresponds approximately to a decrease of 2000 feet altitude. The affected individual is placed within the bubble, the entrance sealed and the bubble is then pressurized to the desired pressure, which will vary, depending on the elevation and severity of symptoms. Frquently it is found that a descent of 2000–4000 feet provides relief; therefore 1–2 pounds per square inch gage of hyperbaric pressure will be adequate in many cases.

Essential features of the bubble for its intended use are that it be lightweight, portable, compactly foldable when not in use, and above all, capable of retaining an internal air pressure of at least greater than 0.2 psi gage and preferably up to 4–5 psi gage, although embodiments capable of retaining up to 10 psi gage are described herein.

The exercisor embodiment is intended to acieve the following goals: to provide a portable structure of light weight, capable of maintaining in its interior an elevated pressure of up to 10 lbs/sq. in. above ambient, to provide sufficient interior volume to permit a human being to carry out fitness training using stationary equipment, to provide a design capable of being executed at a cost commensurate with other items of exercise equipment, and to provide an exercise method for athletes desiring maximal endurance conditioning. The invention is advantageous compared to designs incorporating pressurized helmets, pressure suits and the like, since such devices are cumbersome, awkward and heavy, and interfere with normal freedom of movement required for effective exercise.

The mountain bubble embodiment achieves the following goals: to provide a portable structure of light weight, capable of maintaining in its interior an elevated pressure of up to 10 psi above ambient, to provide sufficient interior volume to permit a human being to sleep within a sleeping bag, to provide a design capable of being executed at a cost commensurate with other mountain survival equipment, to provide a living space for mountaineers suffering from high altitude sickness or who have altitude related sleeping problems.

GENERAL FEATURES OF HYPERBARIC CHAMBERS OF THE INVENTION

Figure 1:
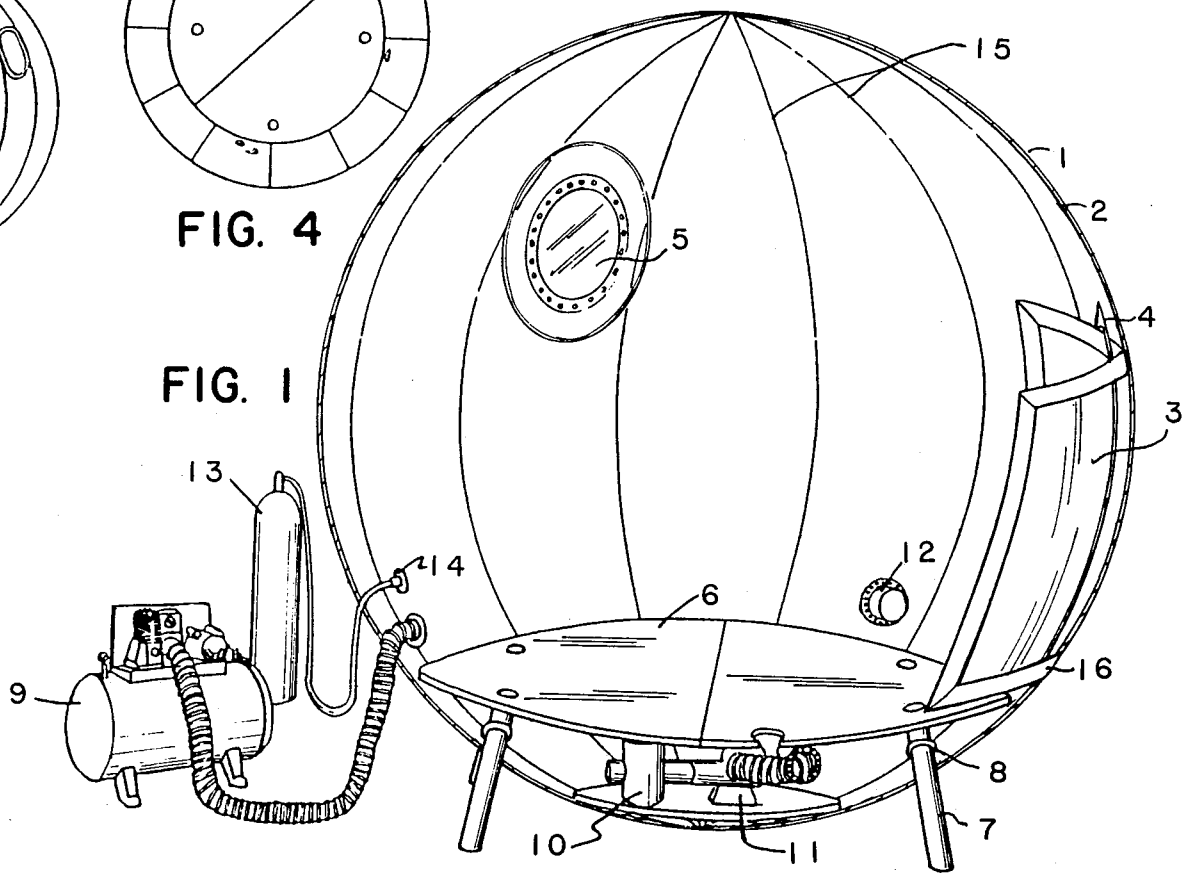
FIG. 1 is a cutaway view of a hyperbaric exercisor embodiment of the invention showing the principal components diagrammatically.

The various embodiments herein described, as well as other embodiments constructed according to the teachings herein, have many structural features in common. The devices are portable, which is defined as not intended for permanent installation, but capable of being collapsed, disassembled and moved from one location to another. The mountain bubble described herein is designed to be light and compact enough to be carried in a backpack as normal emergency equipment of a high altitude expedition. Alternatively, it can be carried in an ambulance as part of standard equipment for emergency treatment of pulmonary edema, at any altitude. The material of the embodiments is flexible, defined as having flexibility characteristics similar to fabric, vinyl or leather. The material is non-breathable, defined herein as substantially gas-impermeable, at least with respect to the major gaseous components of the atmosphere.

The devices of the invention are designed to maintain pressure from 0–10 psi above ambient. For purposes of defining pressures greater than ambient, it will be understood that any such pressure is measured above the normal background of atmospheric pressure fluctuations due to weather. Alternative devices of the invention are designed to maintain pressures form 0.2 psi to 10 psi above ambient, and preferred embodiments maintain pressures from 0.2 psi to 4 psi above ambient.

Many suitable means for introducing air or gas mixtures to achieve a desired pressure are known in the art. The choice thereof will depend on the use to be made of the device, the volume of air to be delivered and the desired rate of circulation. Other considerations, such as temperature, humidity and noise level are also significant. For the mountain bubble, where extreme portability is desired and the total air volume is small, a hand pump such as is used for bicycle tires can be used to inflate the device. For an exercisor, where a larger volume must be filled, an electric or gas-powered compressor can be used. Where a constant air flow at preset pressure is desired, a differential pressure gauge with an exhaust valve may be included. Other means, including supplying air or gas from a pressurized tank may be used, as will be understood by those of ordinary skill in the art. It will also be understood that positive displacement pumping means are required, because fans, blowers and the like are not capable of providing the desired range of pressures.

The internal atmospheric composition can be controlled by means known to the art. As examples without any limitation of such means, known expedients for scavenging $CO_2$ and humidity may be employed, the capacity of such means being provided according to the intended use of the devices. The mountain bubble, enclosing a resting individual, can contain such $CO_2$ and humidity control as required using portable canisters of scavenging materials known in the art. The exercisor devices require larger capacities according to the needs of an exercising person. Alternatively, the exercisor can be provided with a sufficient flow of input air or gas mixture that the device is essentially continuously purged of excess $CO_2$ and humidity. Inasmuch as such means are peripheral to the basic devices, substitutions may be made as desired without the necessity of making major changes to the device itself, all within the scope of ordinary skill as presently known or later devised, according to the desired and intended function of the device.

Temperature can be controlled, where needed, by conventional means external to the devices themselves. For example, a patient in the mountain bubble can be kept warm in a sleeping bag. In the exercisor, cooling is the more likely requirement, accomplished, for example, by passing input air over the cooling coils of an air conditioning unit.

The devices can be constructed of pre-cut panels of flexible, air-impermeable material, preferably vinyl or Kevlar (Trademark, DuPont Corporation, Wilmington, Del.), sewed with overlapping, flat-felled seams, sealed with heat activated tape or preferably electro-welded. Safety may be enhanced by providing an outer shell of lightweight, strong but air-impermeable fabric, such as rip-stop nylon. As is known in the art, if the inner, air-impermeable shell is sized slightly larger than the outer shell, the internal pressure will actually be supported by the outer shell. If a leak or hole should occur in the inner shell, there will not be an explosive decompression or bursting of the inner shell, but only such leakage as occurs through the hole. Further safety could be provided by encasing the structure in a lightweight netting of strong fiber, such as nylon. When an outer shell is used, the inner shell may be constructed of latex or rubber, using, for example, a weather balloon, fitted out with the necessary inlets, outlets and means for ingress and egress, as described herein. Various examples of those expedients are presented in the Examples, and others, as may occur to those skilled in the art, can be used to enhance safety and longevity of the device under field conditions. It is understood in the art that the tensile strength required of the shell material increases directly as the diameter of the chamber. For example, a chamber or bubble of twice the diameter must withstand twice the tensile force at any given pressure. Larger structures therefore warrant greater safety precautions to prevent structural damage.

Optionally, a window can be provided, using a segment of clear vinyl, for example, in order to admit light and reduce feelings of claustrophobia. The shape and placement of windows is a matter of choice available to those skilled in the art.

Fail-safe means for fastening the closure of ingress and egress means can also be provided. For example, the mountain bubble can be closed with lacing or Velcro-type strips to reinforce the air-tight zipper. Such reinforcement can be designed to be operable from inside or outside, depending upon intended use. Thus the exercisor can be designed with reinforcements internally operable, for the convenience of the person using the exercisor. On the other hand, the mountain bubble can be equipped with a reinforcement operable from outside (or from either side) to allow the patient to be assisted by others.

An exercisor embodying the features of the present invention has been constructed entirely from off-the-shelf parts. The basic material itself was 10-oz. polyester based vinyl laminate with transparent 10 mil plastic boat windows. The entire sphere was sewn with 69 weight nylon thread and the seams were sealed with a paraffin wax based solvent sealer. Access into the sphere was through a waterproof, airtight zipper such as is commonly used for underwater dry suits, manufactured by Talon Corporation, Meadeville, Pennsylvania. The sphere was pressurized by means of a commercial rotary van compressor that was oil free. The prototype exercisor was constructed using a Gast rotary compressor model #1022 that can deliver 10 cfm free air at 9 psi and maintain a positive pressure of 10 psi differential. This provided a great deal more pressure than was necessary to simulate sea level, since for example in Denver (5280 feet), only a 2 psi differential is required.

The sphere was constructed by sewing together the panels shown in FIG. 1, using flat felled seams. Such seams are made by sewing together the panels to be joined face to face, then folding the free borders of the joined pieces under and top stitching to create an air-tight, stress-absorbing seam. All seams were formed in this manner, beginning in sequence from the panel adjacent to one side of the zipper tape, and proceeding to join each panel in turn, ultimately joining the last panel to the opposite side of the zipper tape. It is anticipated that radio-frequency welding, rather than sewing, will yield more air-tight seams. The floor was attached, beginning at the airtight zipper tape, sewing around the sphere, easing the floor in by lining up corresponding floor and panel sections as the sewing proceeds around the perimeter of the base. After completing the sewing, all seams were treated with a paraffin wax-based solvent sealer to further reduce air leakage.

Means for ingress and egress are to be provided. Such means must be capable of closure to maintain internal pressure. Examples of such means include a waterproof airtight zipper of the type used in underwater dry suits is described supra. Other means include a non-flexible flap panel, similar to a "doggie door", designed to lay against an o-ring surrounding the opening, to maintain a seal under pressure. The flap panel is preferably molded with a surface curvature conforming to the curvature of the exercisor wall. The actual radius of curvature changes slightly as the pressure is changed, so that the curvature of the flap panel is preferably set to correspond to the exercisor wall curvature that exists near the desired operating pressure.

When the exercisor is constructed of an inner shell and an outer shell, a flap door can be used in the outer shell. In that case, the opening for the door in the outer shell is provided with a frame to maintain shape and provide a frame for the door to rest against when closed. Other types of closure, as known to those skilled in the art, will be suitable.

A flat platform or floor is preferably provided for the exercisor, since the bottom of the device will be rounded at operating pressures. Legs supporting the platform can be attached through holes let in the device, the holes being sealed around the platform legs by means of o-rings or other suitable sealing means. Although the bottom of the mountain bubble is similarly rounded at operating pressures, a comfortable surface for the patient to lie upon can be provided with padding, so no special means for providing a flat bottom are needed.

The bubble can be free-standing, supported by its own rigidity when pressurized, or it can be supported with flexible wands, attached to the inner walls of a conventional tent or provided with inflatable ribs, all according to expedients known in the art of tent design. The problem to be overcome is that the pumping means must be compact and lightweight and therefore likely to be of limited capacity. It is therefore desirable to provide a separate way of initially filling the bubble essentially full to ambient pressure. One expedient is to provide a bubble that is dimensioned to to fit within a conventional mountain tent, with ties, Velcro fasteners (Trademark, Velcro Industries NV, Willamstad, Curacao, Netherlands Antilles) or the like to attach the bubble walls to the tent walls, thereby opening the bubble and filling it with air at ambient pressure. Another embodiment includes flexible wands of, e.g., aluminum or fiberglass which can be inserted in tubes or channels to hold the bubble erect, as in conventional mountain tent design. Such a bubble could be used either free-standing or inside a conventional tent. Another expedient is to provide an inflatable shell around the bubble itself. The outer shell could be pressurized, for example, by hot air provided by a cooking stove. In the latter embodiment, an added advantage of interior warmth and insulation is provided by the outer layer.

Figure 6A:
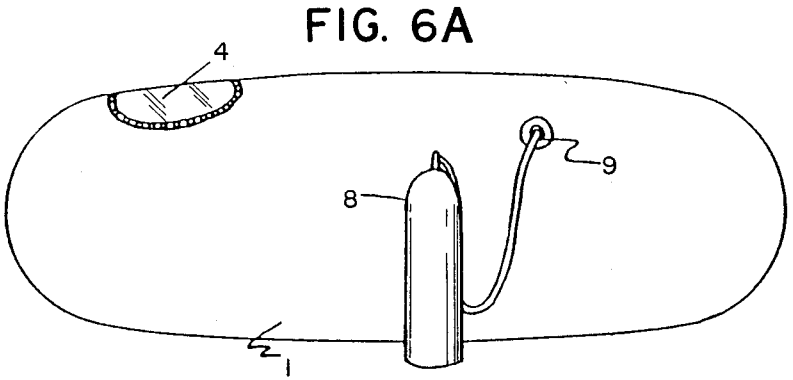
FIG. 6 shows views of a hyperbaric mountain bubble embodiment of the invention from the left exterior (FIG. 6*a*), right exterior (FIG. 6*b*) and in a representative cross section (FIG. 6*c*). Orientation of the mountain bubble is regarded as that of a person lying supine inside the device.
FIG. 6*c* also shows a detail of outer shell seam construction.

A preferred embodiment of the mountain bubble is shown if FIG. 6. The bubble is cylindrical or sausage-shaped, long enough to allow a human subject to lie full length within it, as well as a sleeping bag or blankets for warmth. The diameter is sufficient to provide some air space above the patient. A suitable breathing atmosphere is provided by a portable closed circuit oxygen scuba respiration system such as that manufactured by Rexnord Breathing Systems, Malvern, Pennsylvania, which can be carried inside the bubble. Construction of the mountain bubble follows principles as described for the exercisor, with flexible air-impermeable walls of nylon-supported Kevlar scrim, sealed with an overlapping, preferably heat-activated tape seam and provided with an airtight zipper for ingress and egress while the bubble is depressurized. The material is virtually transparent, allowing full visibility of the subject inside the mountain bubble. An outer shell insulating material is optionally provided for added warmth. The outer shell is preferably closed by a Velcro strip, preferably reinforced by laces or straps. The bubble can be pressurized by a source of compressed air, such as a tank, or, for greatest portability, by a hand- or-foot-operated pump. In either case, it is preferred to have a demand valve incorporated into the side wall of the bubble, adjustable over a range of pressures, to provide the pressure needed for alleviating the patient's symptoms. For maximum utility, the structural components are chosen, according to principles known in the art, to construct a bubble capable of maintaining pressures adjustable in the range from 0 to 10 psi greater than ambient, or preferably from 0.2 to 10 psi greater than ambient. For maximum portability, a most preferred embodiment of lighter weight components will be capable of maintaining pressures adjustable from 0.2 to 4 psi greater than ambient.

It will be apparent that variations in materials, construction techniques, and pressure maintenance and control means are possible within the scope of ordinary skill in the relevant arts. Added refinements, including temperature and humidity control, lighting and electrical hook-ups may be included. Such refinements and modifications alone or in combination are deemed to fall within the scope of the claimed invention, being refinements or equivalents available to those of ordinary skill in the relevant arts.

DETAILED DESCRIPTION OF THE DRAWINGS

FIG. 1—A hyperbaric exercisor having an outer shell (1) of air permeable nylon fabric and an inner shell (2) of air-impermeable vinyl is shown. The inner shell (2) is sized slightly larger than the outer shell (1) so that pressure stress is primarily borne by the stronger outer shell (1). The inner shell (2) is constructed of individual panels joined along seams (15). An airtight zipper (4) in the inner shell provides means of ingress and egress. A flap panel (3) provides a means of ingress and egress through the outer shell. The flap panel (3) opens inwardly through the zipper (4) when the latter is unzipped. A frame (16) is constructed around the flap panel opening to provide a rigid structure for the flap panel (3) to rest against when shut and the exercisor is under pressure. An alternate viewing port (5) is provided. A platform (6) is supported by four legs (7) which extend through the outer and inner shells (1) and (2). The openings for the legs (7) are sealed by o-rings (8). The exercisor is pressurized by an air compressor (9) which delivers air into the exercisor. Excessive internal $CO_2$ and $H_2O$ are removed by a chemical scavenger (10), through which internal air is circulated by a small blower (11). An exit port (12) allows venting of excess pressure, optionally through a differential pressure valve (not shown). Oxygen content of internal air is replenished from a tank of compressed $O_2$ (13), whose flow rate is regulated by an inlet valve (14) in a panel of the exercisor. Optionally, the exercisor can be pressurized by substituting compressed air instead of $O_2$ in tank (13).

Figure 4:
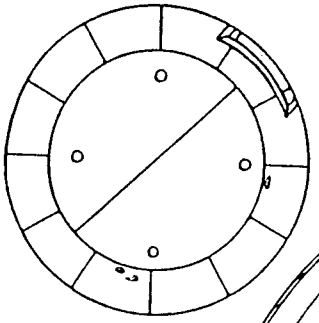
FIGS. 2, 3 and 4 are exterior views of a hyperbaric exercisor, drawn to reduced scale relative to FIG. 1, showing "front", "back" and "top" views, respectively. The top view is actually a cutaway view to show an internal platform and its relative dimensions.
Figure 3:
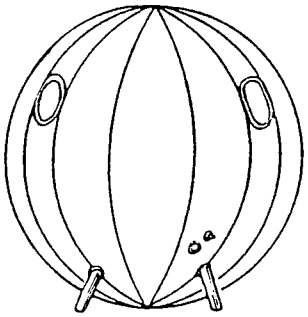
Figure 2:
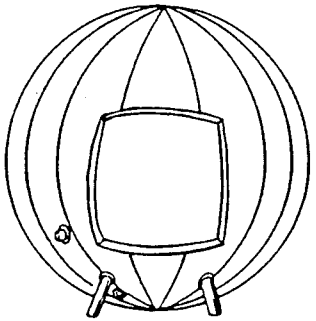

FIGS. 2, 3 and 4 show front back and top views, respectively of the exercisor, drawn to reduced scale. Detachable components such as compressor pump or compressed gas tank are not shown in these views.

Figure 5B:
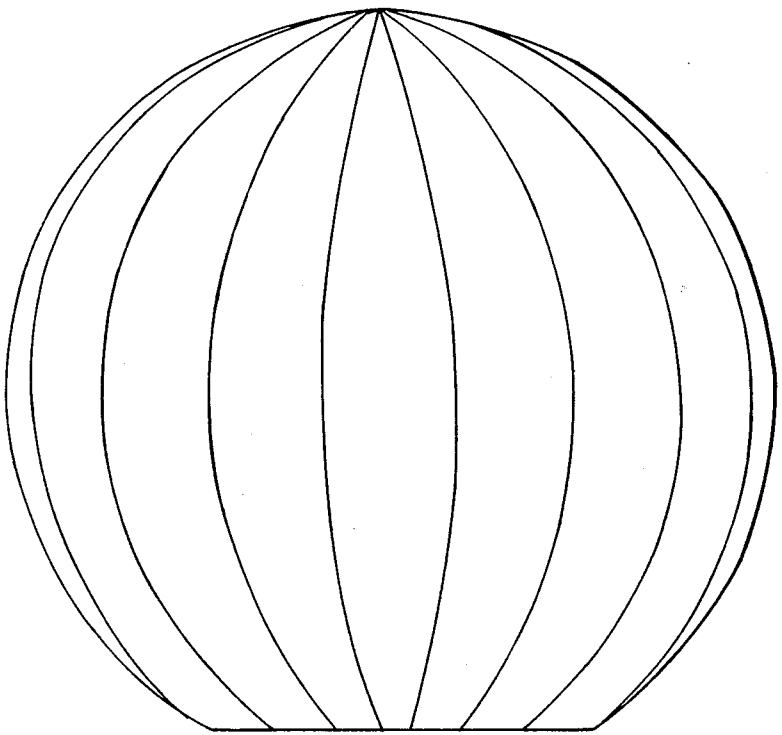
FIG. 5 shows a simplified side view of a hyperbaric exercisor (5*a*) showing component panels, and a representative panel (5*b*) with dimensions as set forth hereinbelow.
Figure 5A:
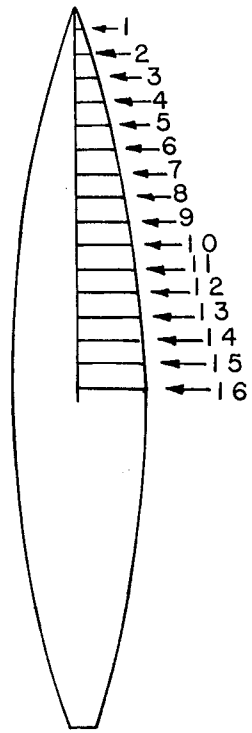

FIG. 5A: This is a representation of how one of the 18 panels is cut. All 18 panels are cut with the same pattern. The arcs are created by 30 short straight cuts. The distances from the center line to the arc for each of the numbered section are given below:

| | | | |
|---|---|---|---|
| 1 | 2.9 cm | 9 | 17.8 cm |
| 2 | 5.1 cm | 10 | 19.1 cm |
| 3 | 7.2 cm | 11 | 20.1 cm |
| 4 | 9.3 cm | 12 | 20.9 cm |
| 5 | 11.3 cm | 13 | 21.4 cm |
| 6 | 13.1 cm | 14 | 21.8 cm |
| 7 | 14.9 cm | 15 | 21.9 cm |
| 8 | 16.4 cm | 16 | 21.9 cm |

The remaining 14 cuts are made symmetrically, taken in reverse order, omitting numbers 1 and 2. Each length is evenly spaced with a separation of 7.6 cm. The panel is symmetric in two dimensions so the remaining three arcs can be made from the same measurements. The bottom two sections (15.2 cm) are cut off to allow for a flat base. These dimensions are valid for a 2.45 meter (8 foot) diameter sphere.

FIG. 5B: This is a schematic of the assembled "chamber". It is made from 18 panels cut with the pattern from FIG. 5A. Optionally, one or more panels may be made of clear or translucent material to improve lighting within. An air tight zipper door is not shown. The diameter of the entire chamber is 2.44 meters or 8 feet. The base is a circular piece of vinyl with a diameter of 1.22 meters (4 feet).

The sphere was constructed by sewing together the panels shown in FIG. 1, using flat felled seams. Such seams are made by sewing together the panels to be joined face to face, then folding the free borders of the joined pieces under and top stitching to create an air-tight, stress-absorbing seam. All seams were formed in this manner, beginning in sequence from the panel adjacent to one side of the zipper tape, and proceeding to join each panel in turn, ultimately joining the last panel to the opposite side of the zipper tape. It is anticipated that radio-frequency welding, rather than sewing, will yield more air-tight seams. The floor was attached, beginning at the zipper tape, sewing around the sphere, easing the floor in by lining up corresponding floor and panel sections as the sewing proceeds around the perimeter of the base. After completing the sewing, all seams were treated with a paraffin wax-based solvent sealer to further reduce air leakage.

Figure 6B:
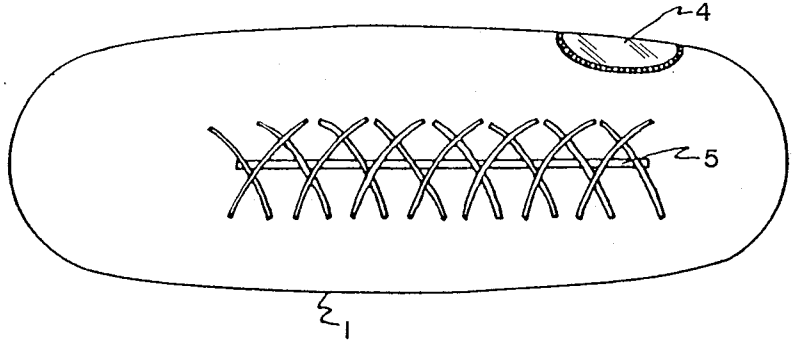
Figure 6C:
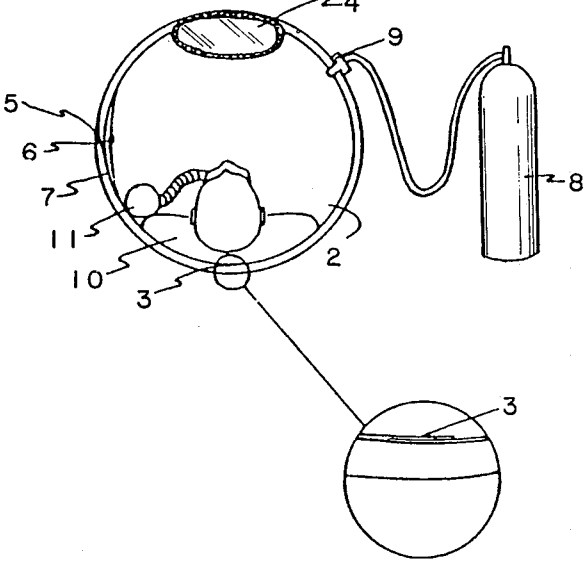

FIG. 6 shows the mountain bubble in exterior views (a) and (b). Visible exterior features include the exterior wall (1), window constructed of clear Kevlar supported nylon membrane (4), Velcro outer closure (5), compressed air tank (8) for achieving and maintaining internal pressure connected to the interior of the bubble by a demand valve (9) adjustable to maintain a predetermined internal pressure. The compressed air tank (8) can be substituted by an optional pump, operable by hand, foot or other power source. In FIG. 6*c*, the bubble is shown in cross section showing a patient (10), lying supine within the bubble. The bubble is constructed with an interior, air-impermeable wall (7) and an exterior, reinforcing wall (1) of air permeable fabric. The means for ingress and egress into the bubble is sealable by an air-impermeable zipper (6) in the inner wall, and a Velcro closure (5) in the outer wall. The outer closure is reinforceable by exterior straps or laces, shown in FIG. 6*b*. A detailed section of FIG. 6*c*, shown in 4× enlargement, depicts the overlapping seam (3) of the internal wall (7) construction. A regulated air supply for the patient (10) is provided by a closed circuit oxygen scuba rebreather (11) of a type such as sold by Rexmord.

In use the bubble is unfolded, the closures (5) and (6) are opened, the subject is placed inside the bubble, the closed circuit rebreather (11) is attached and adjusted, the airtight zipper (6) and outer closure (5) are closed and the bubble is gradually inflated by means of the compressed air source (8) or optional pump, to the desired pressure. For mild cases, relief of symptoms can be obtained by a pressure increment equivalent to an altitude decrease of 2000 to 4000 feet. Therefore, inflation to 1 to 2 pounds psi above ambient may provide relief, although higher pressures will be required in more severe cases. Care should be taken to pressurize the bubble slowly enough to allow the patient to adjust air pressure in the middle ear, as is well known in the art. The internal pressure is then maintained or adjusted upwards or downwards as the patient's condition dictates.

Figure 7:
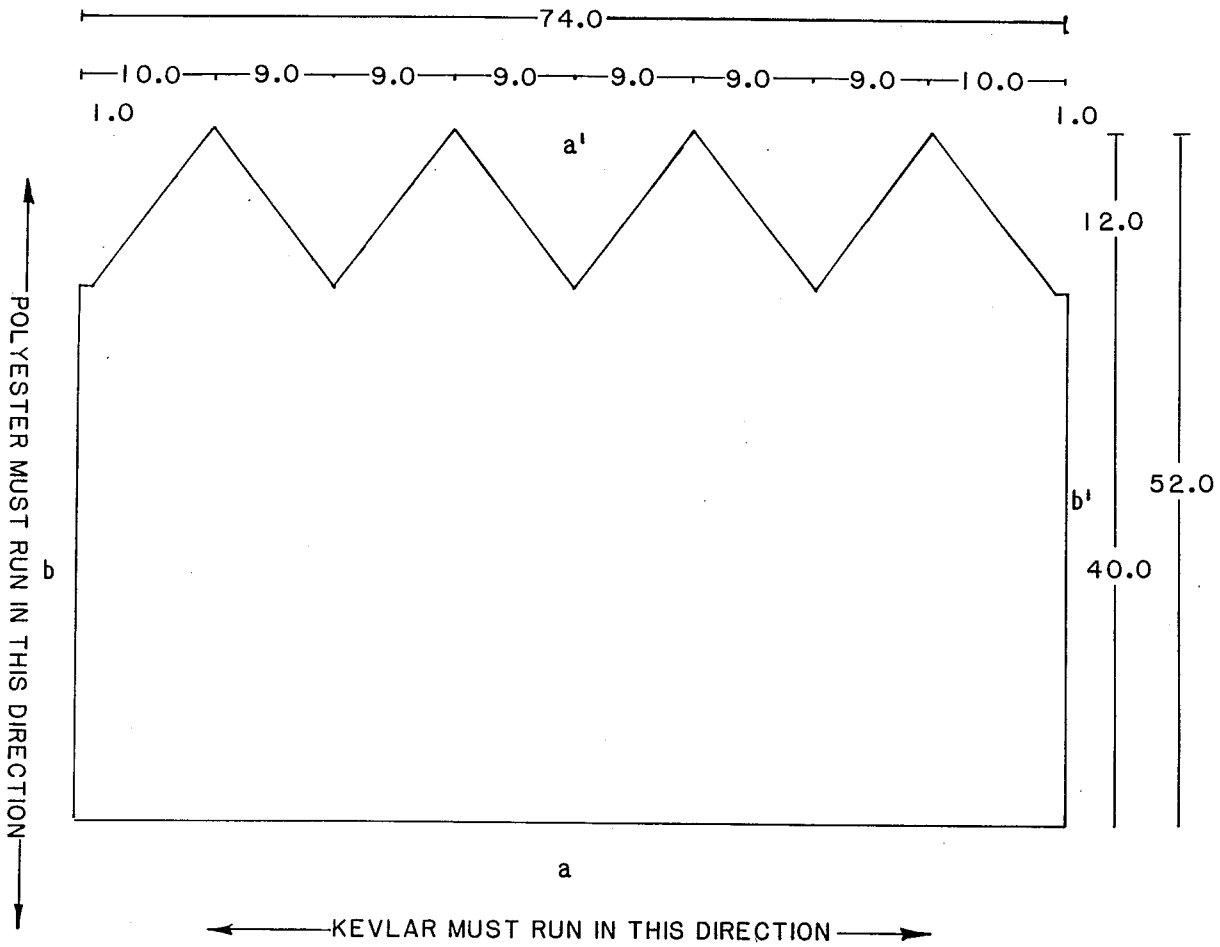
FIG. 7 is a pattern diagram for constructing a mountain bubble embodiment.

FIG. 7 is a pattern, to scale of a hyperbaric mountain bubble. All dimensions are given in inches. Two pieces of 400 denier nylon supported Kevlar scrim (DuPont) cut to the pattern shown in the figure are used to construct the bubble. The material is virtually transparent, allowing the subject inside the bubble to be fully visible. The two pieces are joined together along the straight side (a), using a heat-activated tape such a Scotchweld No. 588 (Trademark, 3M Corporation, Minneapolis, Minnesota). The pieces are formed into a cylinder such that sides (b) and (b′) are contiguous and the ends are closed by overlapping the scalloped edges (a′) and fastening with heat activated tape. The seams formed by joining edges (b) and (b′) are in part sealed with the same tape, and in part with an air-proof zipper such as manufactured by Talon Corporation. The heat activated tape is alson used to seal any inlet or exhaust ports. The finished length of the bag is about 80 inches and the circumference is 74 inches.

We claim:

1. A lightweight, backpackable, inflatable and collapsible hyperbaric chamber having an essentially cylindrical shape when inflated, all sides of which are made of flexible, foldable, non-metallic, non-breathable material, providing sufficient interior volume to permit a human being to sleep within a sleeping bag, said chamber comprising a hand- or foot-operated pump means and differential pressure valve outlet means for achieving and adjusting air pressure inside the chamber adjustable from 0.2–10 psi greater than ambient, and means for human ingress and egress which can be closed to prevent loss of pressurized air.

2. A lightweight, backpackable, inflatable and collapsible hyperbaric chamber having an essentially cylindrical shape when inflated, all sides of which are made of flexible, foldable, non-metallic, non-breathable material, providing sufficient interior volume to permit a human being to sleep within a sleeping bag, said chamber comprising compressed air tank means and adjustable demand valve inlet means connected to said chamber for achieving and adjusting air pressure inside the chamber adjustable from 0.2–10 psi greater than ambient, and means for human ingress and egress which can be closed to prevent loss of pressurized air.

3. The hyperbaric chamber of claim 1 wherein said means for ingress and egress comprises airtight zipper means.

4. The hyperbaric chamber of claim 2 wherein said means for ingress and egress comprises airtight zipper means.

5. A method for alleviating symptoms of mountain sickness in a patient exhibiting said symptoms comprising placing the patient within the hyperbaric chamber of claim 1 and achieving an air pressure therein greater than ambient.

6. A method for alleviating symptoms of mountain sickness in a patient exhibiting said symptoms comprising placing the patient within the hyperbaric chamber of claim 2 and achieving an air pressure therein greater than ambient.

* * * * *